US005144732A

United States Patent [19]

Kuang-Shiung

[11] Patent Number: 5,144,732

[45] Date of Patent: Sep. 8, 1992

[54] PE/PP BAG WEAVING MACHINE WITHOUT A POWER LUBRICATION AND COOLING SYSTEM

[76] Inventor: Fan Kuang-Shiung, Chin-Hwa Street, San-Chung, Taiwan, 241

[21] Appl. No.: 711,897

[22] Filed: Jun. 7, 1991

[51] Int. Cl.[5] ..... C08G 63/78; D03C 13/00

[52] U.S. Cl. ..... 28/182; 139/457; 139/458

[58] Field of Search ..... 28/178, 182; 139/457, 139/458

[56] References Cited

U.S. PATENT DOCUMENTS

| | | | |
|---|---|---|---|
| 2,018,627 | 10/1935 | Apprich | 28/178 X |
| 2,173,997 | 9/1939 | Burgeni | 28/182 X |
| 3,066,720 | 12/1962 | Fontaine | 139/457 X |
| 3,893,412 | 7/1975 | Louch et al. | 28/178 X |

*Primary Examiner*—Werner H. Schroeder
*Assistant Examiner*—Bibhu Mohanty
*Attorney, Agent, or Firm*—Bacon & Thomas

[57] ABSTRACT

A polyethylene/polypropylene bag weaving machine includes a cooling system which eliminates the need for power lubrication. Ribbons being fed to the machine pass over a sponge located in a water tank, thereby moistening the ribbons and ensuring that they stay sufficiently cooling as they enter the weaving device.

2 Claims, 2 Drawing Sheets

PE/PP BAG WEAVING MACHINE WITHOUT A POWER LUBRICATION AND COOLING SYSTEM

BACKGROUND OF THE INVENTION

The present invention relates to an improved polyethylene/polypropylene (PE/PP) bag weaving machine which does not require a power lubrication and cooling system for the machine itself. Instead, before the weaving ribbons reach the weaving device, a lubrication and cooling system including a pallet, a slide rod, and a water tank is provided to lubricate and cool the weaving ribbons directly, thereby preventing the brittleness of the weaving ribbons which would otherwise be caused by the high temperature resulting from the friction between the weaving ribbons and the weaving PE/PP bag during the weaving process. In addition, the disadvantage of being unable to print on a PE/PP weaving bag manufactured by a conventional method using lubrication oil cooling is eliminated by eliminating the need for lubrication oil cooling.

It is well known that during the weaving process used for manufacturing a PE/PP bag, the friction of the weaving ribbons and the weaving bag produces a high temperature and makes the weaving ribbons brittle, affecting the quality of product. Also, when weaving ribbons are not lubricated, they are harsh and difficult to weave. It is further well known that the lubricating cooling system of a conventional PE/PP bag weaving machine usually includes an oil cup on the top edge of the weaving machine, and a power system by means of which the lubricating oil inside the oil cup is evenly coated on the weaving ribbons, after which a blower is used to blow the cooling air on the ribbon, so as to achieve lubrication and cooling effects. However, the conventional lubrication and cooling system is subject to the following problems:

(1) The oil cup must be power operated to pump the oil, and an additional blower is required to provide the cooling air. The process is therefore not only complicated, but also consumes much power, and the continuous consumption of the lubrication oil increases the production cost;

(2) Although the lubrication oil has lubricating and heat dissipating effects, the oil pollution on the surfaces of the weaving ribbons leads to either a stripping hazard during printing, or unprintability of the bag.

In view of the above problems, the present invention has been created to provide a lubrication and cooling system before the weaving ribbons reach the weaving device, and to use the water in a water tank to lubricate and cool the weaving ribbons directly, so as to avoid any brittleness resulting from high temperature produced by friction during the weaving process, which may affect the product quality, and at the same time to eliminate the disadvantage that it is difficult or impossible to print on a PE/PP weaving bag manufactured by conventional methods using lubrication oil cooling.

Therefore, the main object of the present invention is to provide a PE/PP bag weaving machine without a power lubrication and cooling system, and which uses water to lubricate and cool the weaving ribbons, so that no power is required and other material costs can be saved.

Another object of the present invention is to moisten the weaving ribbons during the weaving process so that, after high temperature evaporation, printing on the surface of the PE/PP bag will be possible.

DETAILED DESCRIPTION OF THE PREFERRED EMBODIMENTS

The above-described and other objects, features and advantages of the present invention will be more apparent from the following description quoted on the basis of annexed drawings as follows. The preferred embodiment drawing is to explain the present invention and is not to be understood as limiting the present invention in any way.

Figure 1:
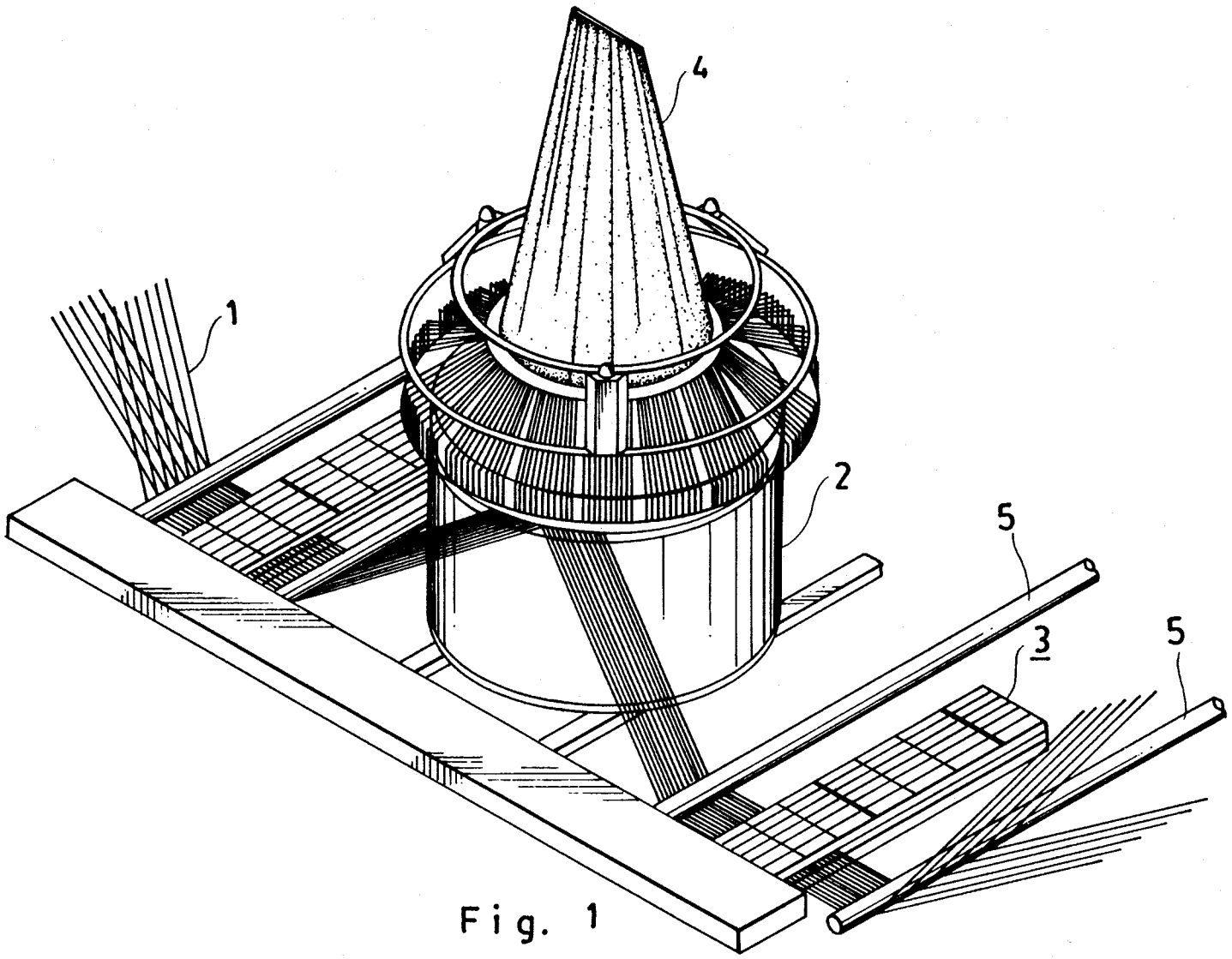
FIG. 1 is a schematic drawing showing an example of a preferred embodiment of the present invention.
Figure 2:
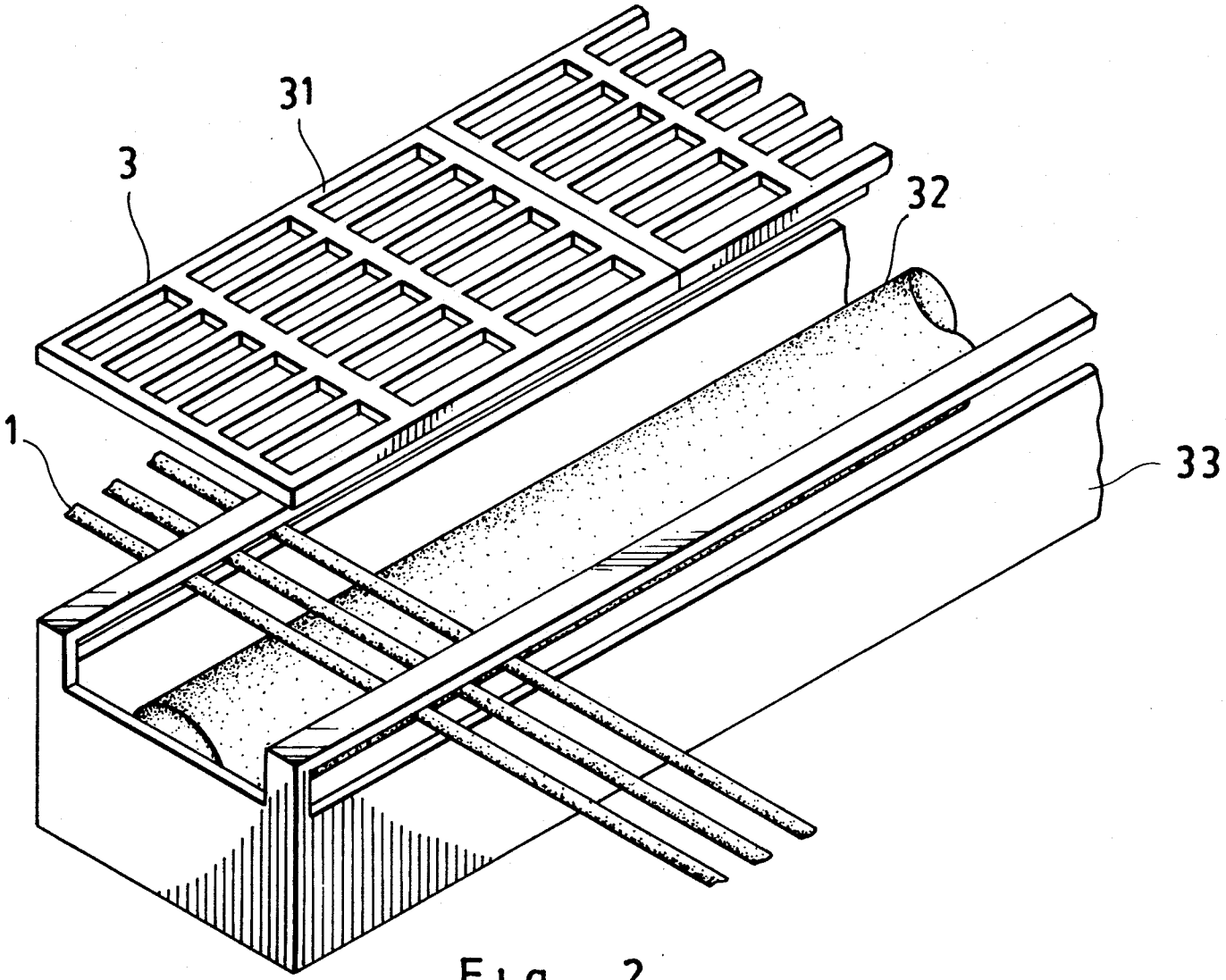
FIG. 2 is an exploded perspective view of one of the two weaving ribbon cooling and lubrication devices shown in FIG. 1.

Referring to FIGS. 1 and 2, before the weaving ribbon (1) reaches the weaving device (2), it passes through a lubrication and cooling system (3) including, as best shown in FIG. 2, a pallet (31), a slide rod (32) which is wrapped externally with a moisture material (e.g., a sponge), and a cooling water tank (33). The ribbons are guided through system (3) by means in the form of guide rods (5) which then guide the ribbons to weaving device (2). The pallet (31) is simply a lid for the water tank and is shown in exploded view FIG. 2 as being removed from the water tank. Approximately half of slide rod (32) is preferably under the water level of the cooling water tank (33), so that the weaving ribbons (1) may be sufficiently moistened as they slide over the slide rod (32) and will not be harsh and can be woven smoothly during the weaving process of manufacturing the PE/PP bag (4). This moistening prevents brittleness of the weaving ribbons due to the high temperature resulting from friction between the weaving ribbons (1) and the PE/PP bag during the weaving process, which affects the product quality. Also, high temperature evaporation of the moisture, as a result of the high temperatures during weaving, results in a dry and easily printable bag surface, whereas PE/PP weaving bag (4) coated with lubrication as in the conventional machine is unprintable or not easy printable.

An essential feature of the present invention is that the lubrication and cooling system requires no external power and is integrated with the weaving device (2) in operation, thus eliminating waste of power consumption and saving material costs.

I claim:

1. In combination with a polyethylene/polypropylene bag weaving machine, a cooling system which includes a slide rod; a water tank in which the slide rod is situated; means for guiding a polyethylene/polypropylene ribbon over the slide rod before the ribbon enters the weaving device; and moistening means on said slide rod for contacting and moistening said ribbon as it passes over the slide rod, whereby brittleness of the ribbon due to high temperature heating in the weaving device is prevented, and whereby printing on the resulting polyethylene/polypropylene bag is facilitated.

2. The combination as claimed in claim 1, wherein said means for moistening said ribbon comprises a sponge.

* * * * *